US009526341B2

(12) United States Patent
Glöckl

(10) Patent No.: US 9,526,341 B2
(45) Date of Patent: Dec. 27, 2016

(54) SEATING HAVING A PENDULUM COLUMN AND SAFETY DEVICE

(71) Applicant: AERIS GMBH, Haar bei München (DE)

(72) Inventor: Josef Glöckl, Kirchheim (DE)

(73) Assignee: aeris GmbH, Haar bei München (DE)

( * ) Notice: Subject to any disclaimer, the term of this patent is extended or adjusted under 35 U.S.C. 154(b) by 0 days.

(21) Appl. No.: 14/433,836

(22) PCT Filed: May 16, 2013

(86) PCT No.: PCT/EP2013/060128

§ 371 (c)(1),
(2) Date: Apr. 6, 2015

(87) PCT Pub. No.: WO2014/060121

PCT Pub. Date: Apr. 24, 2014

(65) Prior Publication Data

US 2015/0272331 A1 Oct. 1, 2015

(30) Foreign Application Priority Data

Oct. 19, 2012 (DE) ..... 10 2012 110 031

(51) Int. Cl.
*A47C 3/026* (2006.01)
*A47C 9/00* (2006.01)
*A47C 3/02* (2006.01)

(52) U.S. Cl.
CPC *A47C 3/026* (2013.01); *A47C 3/02* (2013.01)

(58) Field of Classification Search
CPC ..... A47C 3/02; A47C 3/026
USPC ..... 297/314, 461
See application file for complete search history.

(56) References Cited

U.S. PATENT DOCUMENTS 4,099,697 A * 7/1978 Von Schuckmann .. A47C 3/026 297/314 X
5,921,628 A * 7/1999 Glockl ..... A47C 9/002 297/338
6,106,064 A * 8/2000 Hibberd ..... A47C 3/025 297/314 X (Continued)

FOREIGN PATENT DOCUMENTS

DE 12 05 666 B 11/1965
DE 36 12 201 A1 10/1987

(Continued)

*Primary Examiner* — Rodney B White
(74) *Attorney, Agent, or Firm* — Dickinson Wright PLLC

(57) ABSTRACT

Active dynamic seating is provided comprising (1) a foot part (2), a seat (3) and a deflectable pendulum column (4) that is designed as a main pillar. The pendulum column is connected to the foot part (2) by means of a pendulum joint (5) that counteracts a deflection with a restoring force, and the seat (3) is resiliently arranged at/on the pendulum column. The seating further comprises a device (6) for defining the rearward direction, e.g. a backrest or a similar design element, which device is arranged on the seat. The foot part (2) of the seating is provided with a safety element (7) which counteracts a rearward pendulum motion of the pendulum column (4) with a higher resistance than the resistance of the restoring force in the other directions, said safety element (7) having a deflection limiter (8) formed in the pendulum joint (5).

17 Claims, 9 Drawing Sheets

(56) References Cited

U.S. PATENT DOCUMENTS

Figure 1:
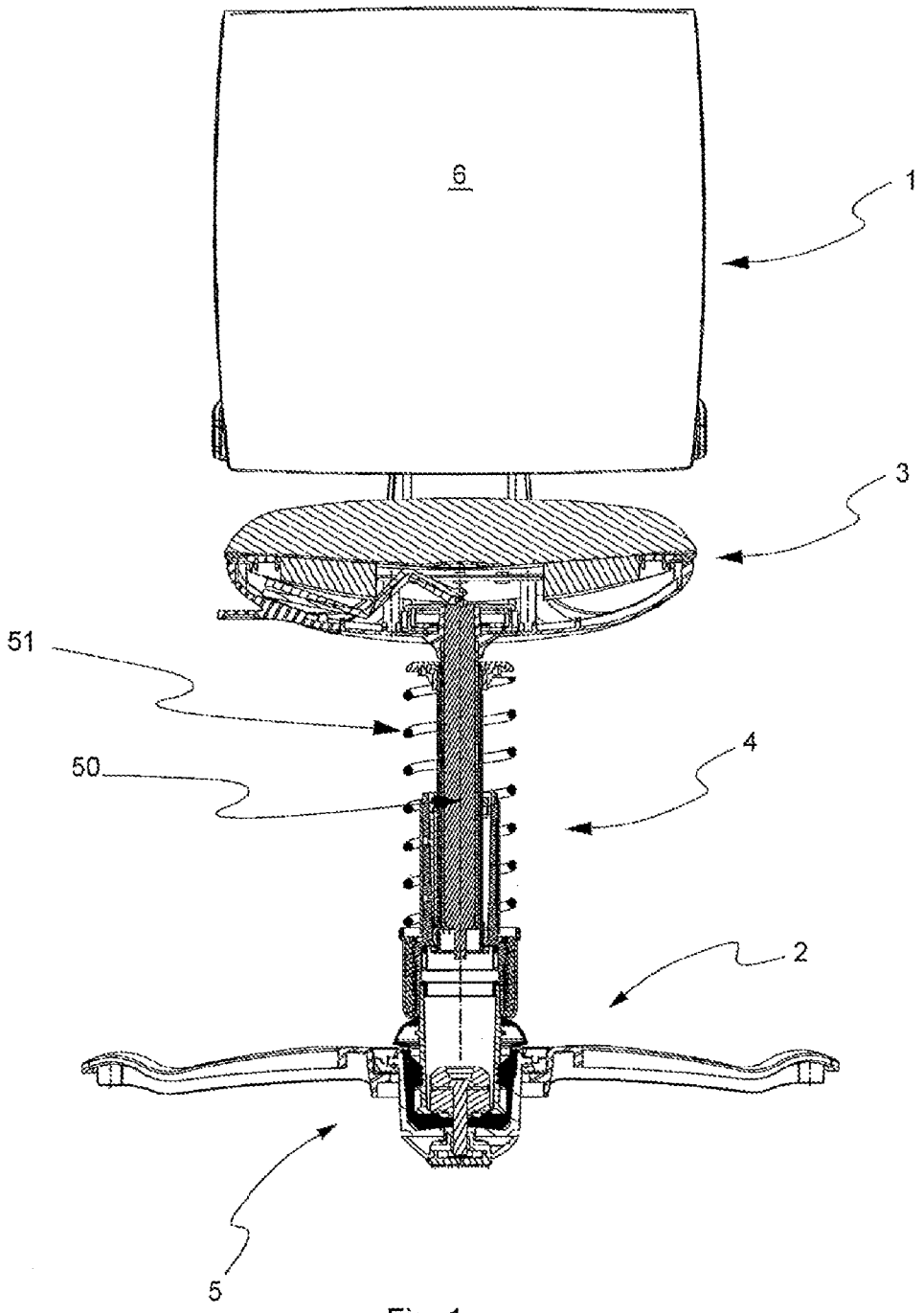

| | | | | |
|---|---|---|---|---|
| 6,206,335 | B1 * | 3/2001 | Huber | A47C 21/006 297/314 X |
| 6,601,818 | B1 * | 8/2003 | Larsen | A47C 3/0255 248/158 |
| 6,997,511 | B2 * | 2/2006 | Marchand | A47C 9/025 297/314 X |
| 7,547,067 | B2 * | 6/2009 | Keilhauer | A47C 3/02 297/314 X |
| 8,066,624 | B1 * | 11/2011 | Stroup | A47C 7/004 297/338 |
| 8,540,314 | B2 * | 9/2013 | Fernandez | A47C 3/30 297/314 |
| 9,016,786 | B2 * | 4/2015 | Glockl | A47C 3/22 297/313 |
| 9,226,556 | B1 * | 1/2016 | Chien | A61H 3/0288 |

FOREIGN PATENT DOCUMENTS

| | | | |
|---|---|---|---|
| WO | 97/27785 | A1 | 8/1997 |
| WO | 2006/056051 | A1 | 6/2006 |

* cited by examiner

Detail B - Inclination to the left a)

Detail B - Vertical position b)

Detail B - Inclination to the right c)

Sectional view A-A

Detail C

SEATING HAVING A PENDULUM COLUMN AND SAFETY DEVICE

The invention relates to actively dynamic seating comprising a foot part, a seat and a deflectable pendulum column that is in the form of a supporting leg and is connected to the foot part by means of a pendulum joint which counteracts a deflection with a restoring torque and at/on which joint the seat is spring-mounted, and comprising a means for defining the backward direction, e.g. a rest or a similar seating design.

The human locomotor system requires and demands constant activity. It needs movement for healthy development and maintaining its function. Modern everyday life forces people to sit for hours at a time; an actively dynamic seat provides the user with seating which can be moved in three dimensions for dynamic and ergonomically practical sitting. By moving the body in three dimensions when sitting, the user strengthens their back by means of continuous training of the musculature, and keeps their intervertebral discs, tendons and joints active.

When sitting on such a seat, the user is constantly required to keep their body always slightly moving by keeping their balance on the sprung seat. As a result, the user sits with a straight posture, and therefore the intervertebral discs are subject to uniform loading. The movability of the seat constantly encourages the user to sit up straight and to change their posture so that the intervertebral discs remain loaded in parallel with alternating pressure points.

Since the entire body is constantly active, almost all of the muscle groups also remain active and therefore are strengthened over time and can keep the back upright better.

EP 0 808 116 B1 discloses generic seating which comprises a restoring device on a foot part. This restoring device is made of rubber-bonded metal and consists of a tubular upper part, a lower part and a resilient material arranged between the upper part and the lower part. The lower part, which is rigidly connected to an arm of the foot part, encompasses the upper part in the shape of a cup, the resilient material being arranged not only between the end faces but also between the side walls. The upper part and the lower part are interconnected by means of a screw, wherein, by means of an adjusting nut which interacts with the screw, the restoring device can be biased and thus the restoring force can be adjusted.

Such a stool can be equipped with a backrest. There is then a need to limit the rocking movement in at least one direction, in particular backwards, so that when the user leans back against the rest, they do not accidentally tip over backwards.

The problem addressed by the invention is that of developing generic seating such that accidentally leaning back cannot lead to the seating falling over.

This problem is solved in generic furniture in that the foot part of the seating is equipped with a safety element which counteracts a rocking movement of the pendulum column towards the back with a resistance which is higher than the resistance of the restoring torque in the other directions. As a result of increasing the pendulum resistance in the backward direction, the user is provided with the signal not to generate any additional pendulum pressure in this direction.

An advantageous embodiment provides that the safety element has a deflection limit formed in the pendulum joint. As a result of the limit on deflection, the centre of gravity of the user is prevented from being able to be displaced beyond the support region of the base. Because this deflection limit is formed in the pendulum joint, costs for an additional supporting structure are avoided and the aesthetic appearance of the furniture is not affected.

In this case it is advantageous for the pendulum joint to comprise a pivot cup consisting of an elastomer, having a resilient wall and resilient base and being arranged in a rotatably mounted receiving unit, the pendulum column being provided with a supporting leg end on the lower end thereof, which end is resiliently received in the pivot cup, and the wall of the pivot cup comprising a radially inwardly projecting protrusion in the region of the upper edge in the rear region, which protrusion has a lower flexibility than a bead formed in the remaining region on the inner circumference of the pivot cup, the outer wall of the supporting leg end being in contact with the protrusion and the bead.

A particularly advantageous embodiment provides that the protrusion projects into the inside of the pivot cup in the form of a circular segment and, at the location of the circular segment, on the outside of the pivot cup, a detachable crescent-shaped insert stiffens the protrusion. The insert is inserted in a correspondingly shaped insert recess.

In this case, it is advantageous for the wall of the pivot cup in the base region to have a widening relative to the region comprising the protrusion, in which widening a nose-protrusion formed in the base region of the supporting leg end engages. As a result, the force from the pivot cup which generates the restoring torque during the backward rocking acts on the pendulum column at an advantageous angle.

For a high restoring torque in the backward direction, it is advantageous that the base of the pivot cup is formed so as to be thinner in the region underneath the protrusion than in the region underneath the recess, and that the thinner base region is supported on a support arranged in the receiving unit.

The supporting leg end is formed with an end plate on which a resilient tension element formed in the manner of a rubber-bonded metal is arranged. In this case, the tension element comprises a fastening bolt which is guided through aligned openings in the supporting leg end, the cup and the receiving unit and is adjustably screwed together on the outside under the receiving unit by means of a fastening nut. The fastening nut can be fixed to a handwheel so that it is possible to carry out an adjustment without a tool.

It is advantageous that the seat, the pendulum column and the self-aligning bearing are interconnected for conjoint rotation, and the unit formed thereby is mounted so as to be able to rotate about the column axis S relative to the foot part.

The receiving unit is provided on the upper opening thereof with a circumferential edge which is formed so as to extend radially outwards as an upper bearing ring having a bearing passage pointing downwards. This interacts directly or indirectly with a lower bearing ring which is provided in the foot part and has a bearing passage pointing upwards, the receiving unit being held on a receiving surface in the foot part by means of a threaded ring in the form of an adjusting ring which allows rotation of the receiving unit.

In this case, it is provided that on the adjusting ring, which has a fine thread and which acts on the circumferential edge of the unit from above and rests thereon in sliding contact, and on the lower bearing ring a measuring device is formed according to the principle of a micrometer. The arrangement can thus allow easy or difficult rotation in a precisely measured manner.

Eight threaded holes ($G_1$-$G_8$) for a cover ring and four through-holes, and three pins pointing downwards which can interact with nine measuring holes in the lower bearing ring, are formed in the threaded securing ring, wherein all of the holes are concentric and are each at the same angular distance from each other, with the condition that one pin and one through-hole in the cover ring are located on a common radius and that a measuring hole ($M_1$) is arranged symmetrically between two threaded holes ($g_1$, $g_2$).

In an advantageous embodiment of the invention, it is provided that the protrusion in the joint region extends over a circumferential angle of approximately 45° and, in the remaining circumferential region, a circumferential bead is in contact with the wall of the supporting leg end A and holds said leg end in the vertical position in a deflectable manner.

Advantageously, it is provided that the pivot cup comprises a sealing sleeve around the upper opening thereof and, underneath said sleeve, a circumferential groove on the outer circumferential edge, into which groove a retaining rib formed on the inner circumferential edge of the cover ring is inserted.

Depending on the field of application, it can be provided that the means for defining the backward direction is a backrest. In another field of application, the means for defining the backward direction can be a seat in the shape of a saddle.

Figure 2A:
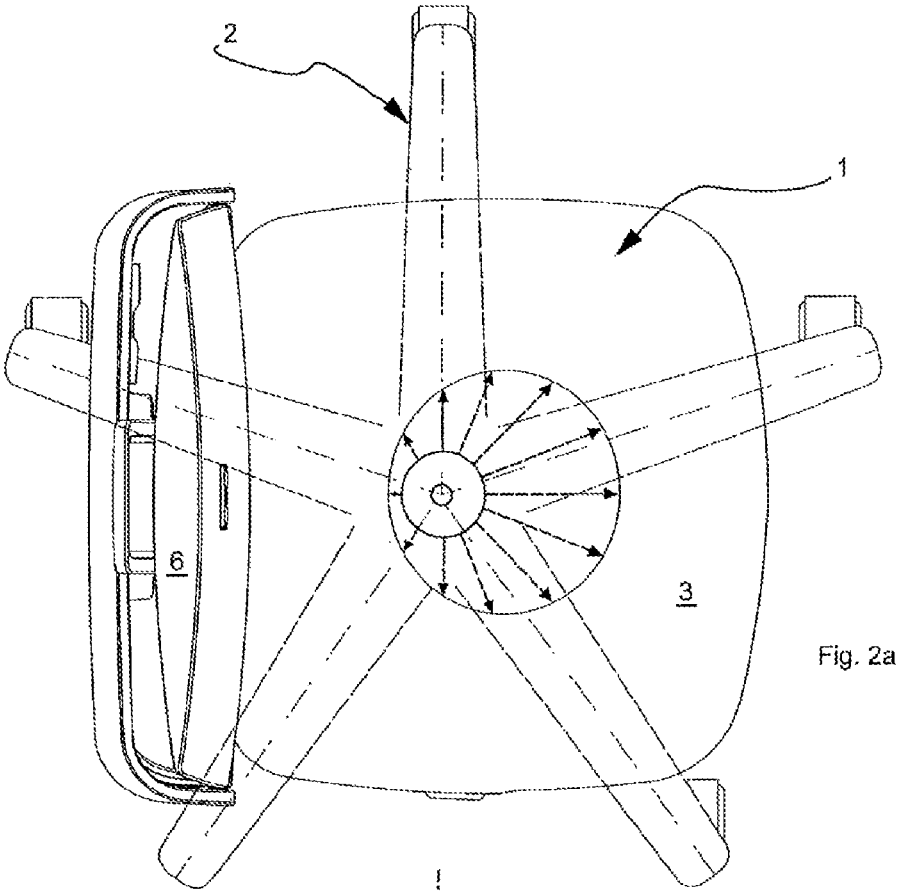
Figure 2B:
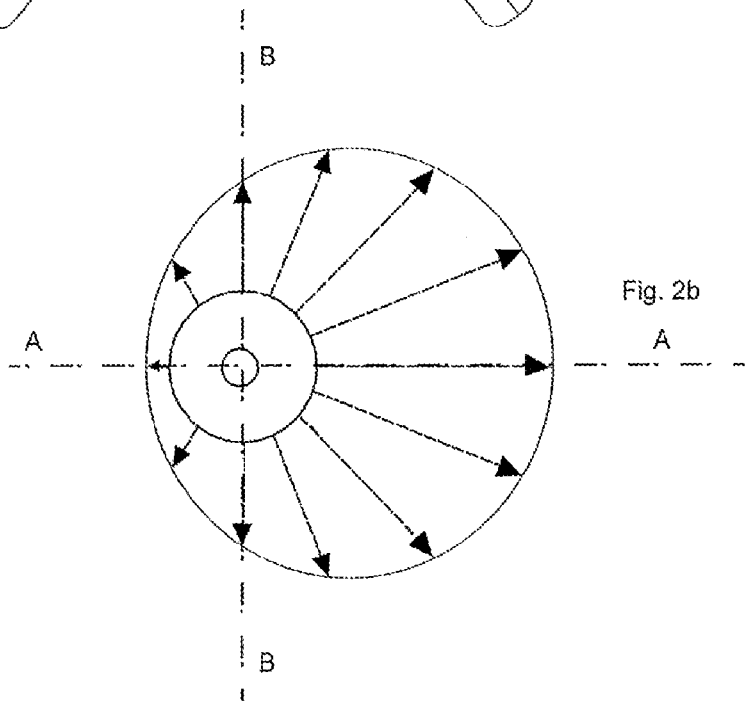
Figure 3:
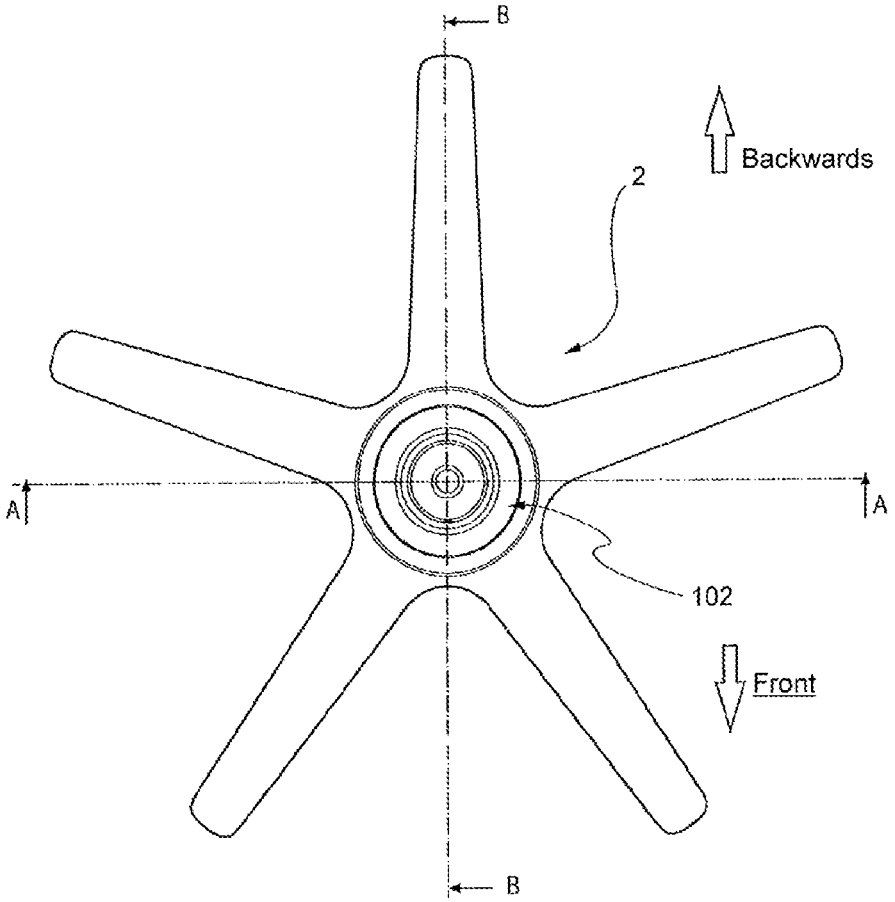
Figure 4:
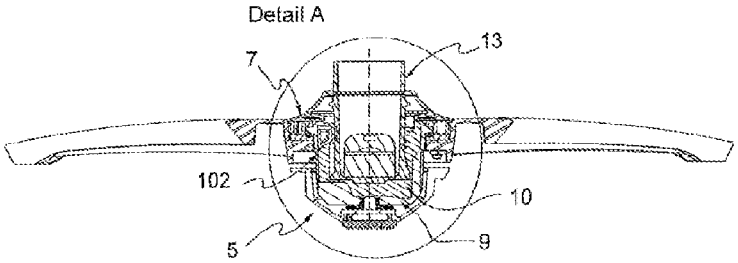
Figure 5:
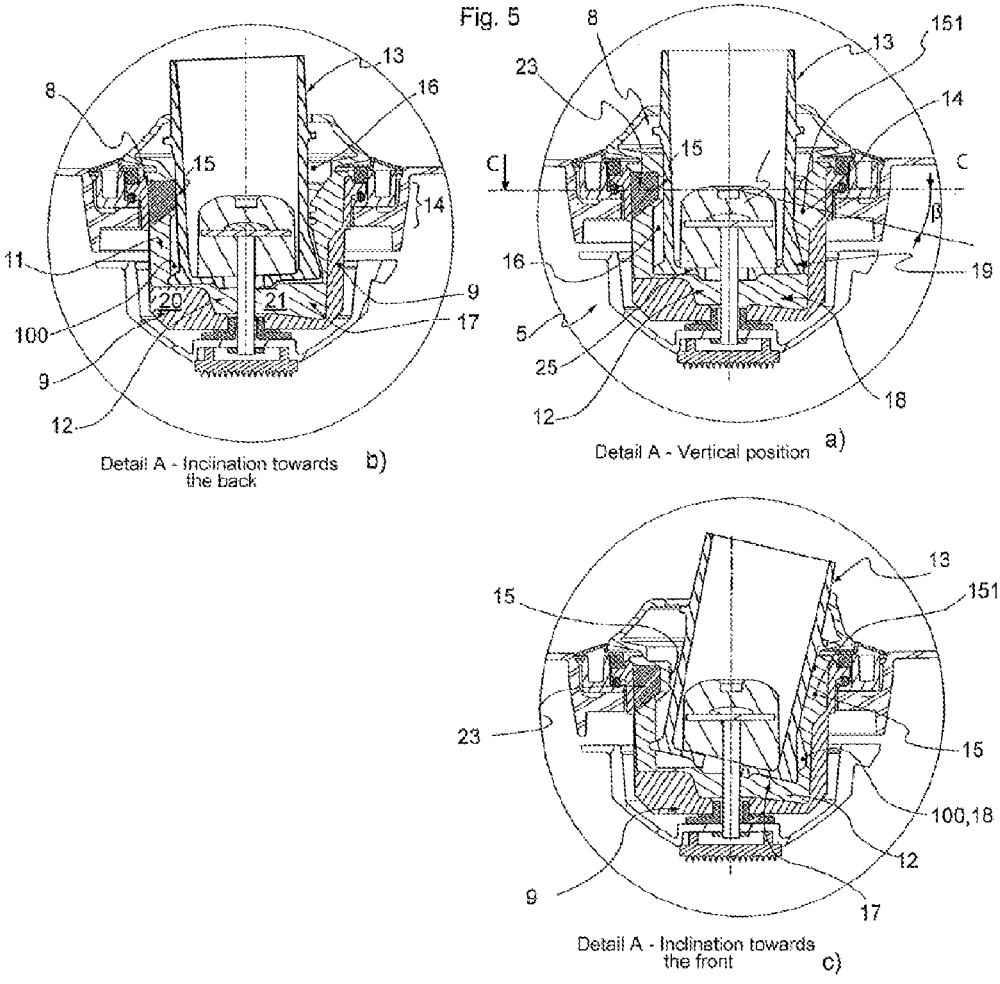
Figure 5:
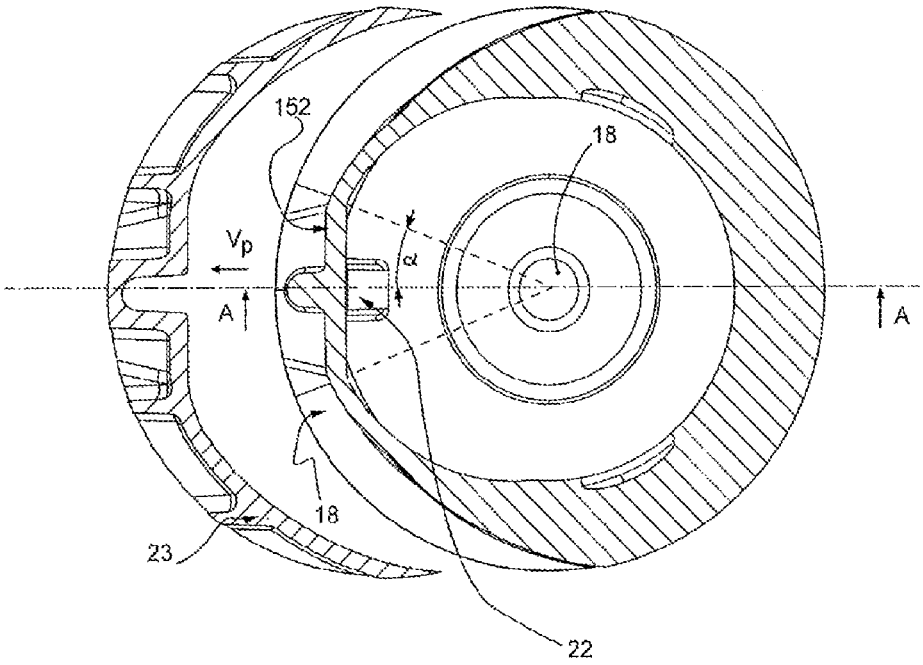
Figure 5:
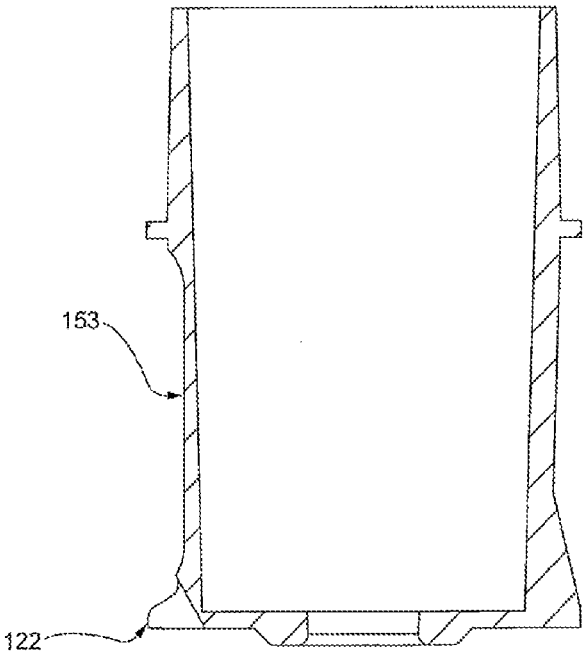
Figure 6:
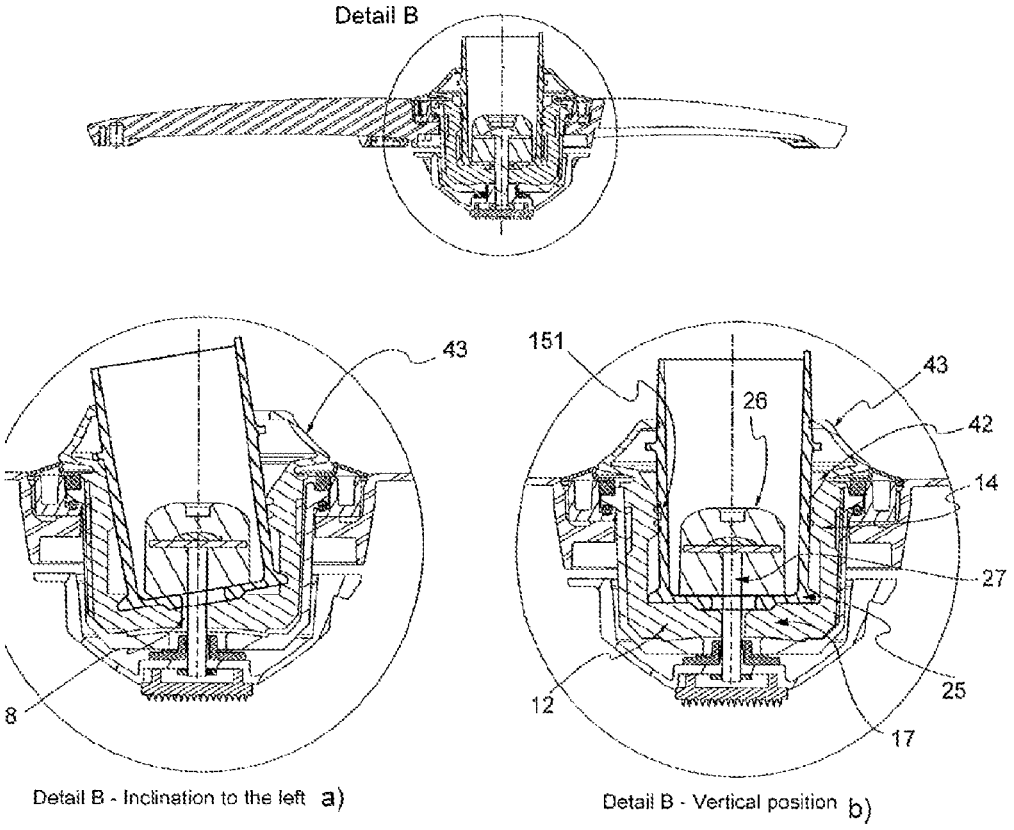
Figure 7:
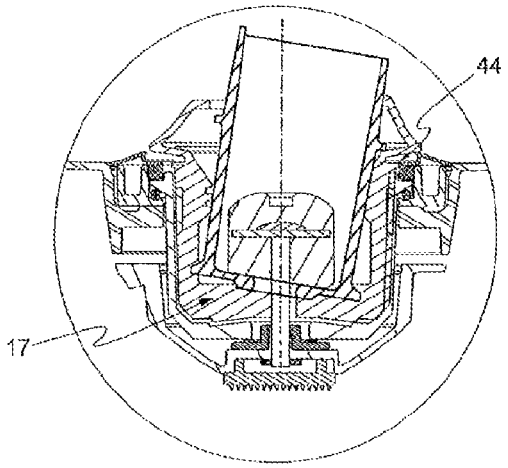
Figure 8:
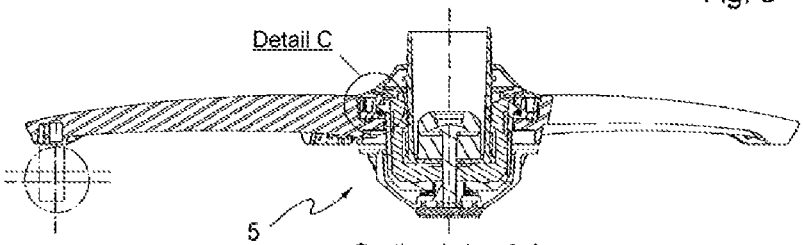
Figure 9:
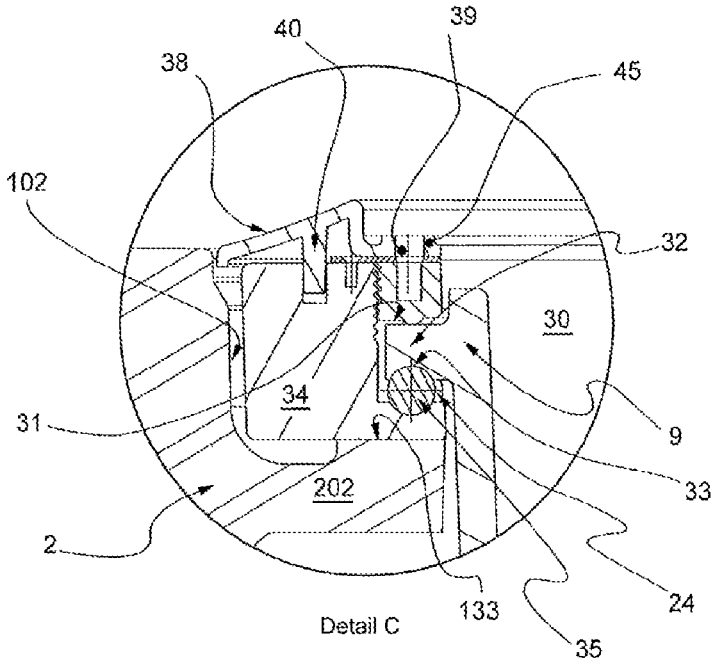
Figure 10:
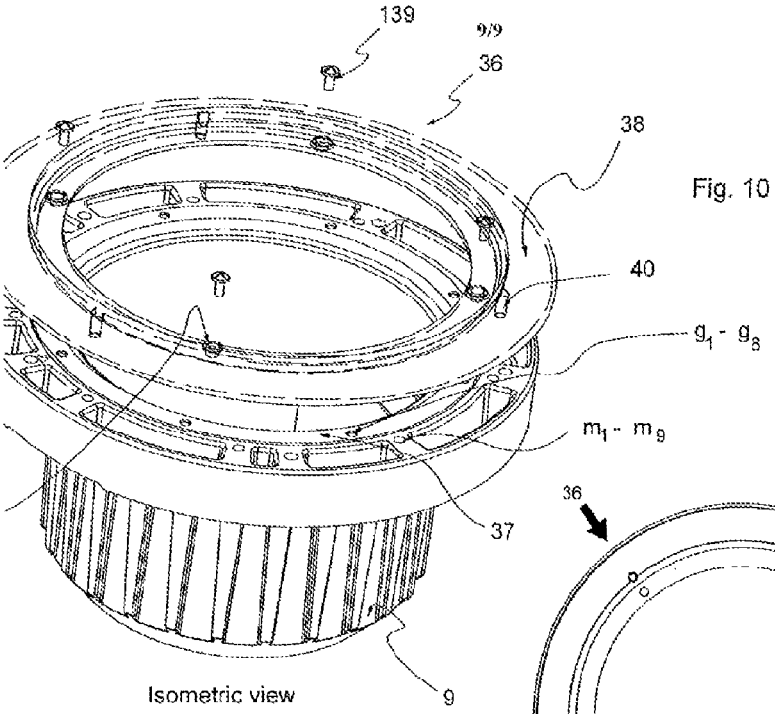
Figure 11:
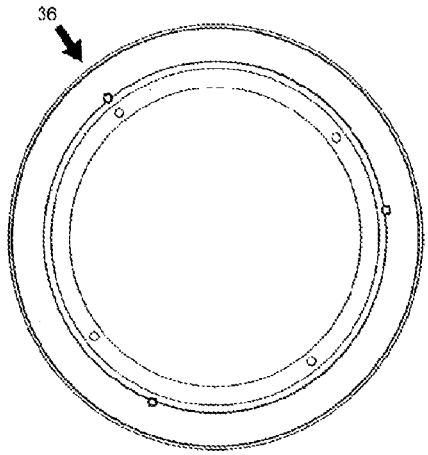
Figure 12:
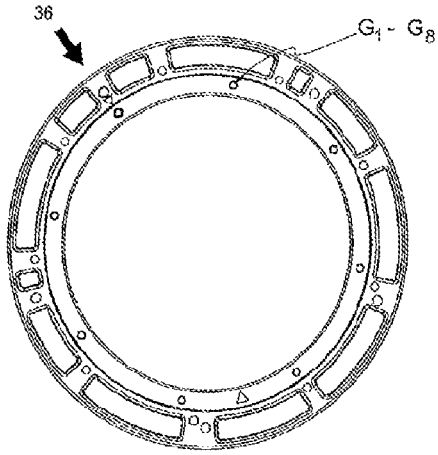

The invention will be explained in greater detail below with reference to the embodiments shown in the drawings, in which:

FIG. 1 is a partially sectional front view of seating according to the invention, comprising a seat, a foot part and a pendulum column in the form of a supporting leg, FIG. 2*a* is a schematic plan view of the seating from FIG. 1 with a vector diagram of the restoring torque plotted thereon, FIG. 2*b* is an enlarged view of the vector diagram of the restoring torque shown in FIG. 2*a*, FIG. 3 is a plan view of the foot part comprising a pendulum column having a main axis A-A, FIG. 4 is a schematic side view of a section through the foot part comprising a pendulum joint along the axis A-A, with some regions only shown in part, FIG. 5 is an enlarged view of the detail A from FIG. 4, more specifically a) a side view of the pendulum joint from FIG. 4 in a vertical position,
b) a side view of the pendulum joint from FIG. 4 in a backwardly inclined position,
c) a side view of the pendulum joint from FIG. 4 in a forwardly inclined position,
d) a view of a section along the line C-C in FIG. 5*a* with an insert,
e) a partially sectional side view of a supporting leg end,
f) a perspective view of the section from FIG. 4, FIG. 6 is a schematic front view of a section through the foot part comprising a pendulum joint along the axis B-B, with some regions only shown in part, FIG. 7 is an enlarged view of the detail B from FIG. 6, more specifically a) a view of the pendulum joint from FIG. 6 in a rocking position inclined to the left,
b) a view of the pendulum joint from FIG. 6 in a vertical position,
c) a view of the pendulum joint from FIG. 6 in a rocking position inclined to the right, FIG. 8 is a schematic front view of the foot part comprising a pendulum joint of the section along the line B-B, with some regions only shown in part and with the detail C with the cover ring, FIG. 9 is an enlarged view of the detail C from FIG. 8, FIG. 10 is an isometric view of the receiving unit with the bearing ring, and the threaded securing ring together with the cover ring, FIG. 11 is a plan view of the upper bearing ring, FIG. 12 is a plan view of the lower bearing ring.

DETAILED TECHNICAL DESCRIPTION

FIG. 1 shows an actively dynamic seating in a partially sectional front view. As already explained above, actively dynamic seating is characterised in that the seat firstly can bounce up and down and at the same time can carry out rocking movements in any desired direction.

The actively dynamic seating 1 consists of a foot part 2, a seat 3, a backrest 6 fixed to the seat and a pendulum column 4, wherein the pendulum column 4 is connected to the foot part 2 by means of a pendulum joint 5.

In the embodiment shown, the seat is fastened to a pneumatic spring 50 and can move up and down by means of the helical spring 51, which is supported at one end on the seat 3 and at the other end indirectly on the foot part 2. By means of the pendulum joint 5, the pendulum column 4 can rock in three dimensions.

In FIG. 2*a*, the seating 1 according to the invention is shown in a front view, wherein in the middle of the surface of the seat 3, a schematic view of a diagram is displayed which illustrates the rocking movement of the seat. The diagram is shown in an enlarged view in FIG. 2*b* and shows that along the axis A-A, towards the front, the rocking movement is at its greatest, and in the diametrically opposite direction towards the back, the rocking movement is virtually zero. Between the pendulum movement towards the back and the pendulum movement towards the front, a continuous increase in the degree of the pendulum deflection can be seen. In the direction of the axis B-B which is perpendicular to A-A, pendulum movements can also still be seen, but the vector thereof is kept smaller than that in the case of a deflection towards the front.

FIG. 3 shows an embodiment of the foot part 2. In the embodiment shown, the foot part 2 is a star with five arms, as is conventionally used in office chairs. Instead of a star-shaped base of this type, other base plates are also possible, such as a round base plate or a foot plate with edges in the shape of a polygon. The foot part has a central opening 102, into which the pendulum joint 5 is inserted. In FIG. 3, the sectional axes A-A and B-B are shown, the sections of which are explained in greater detail below.

FIG. 4 is a schematic side view of a section along the line A-A in FIG. 3 through the foot part 2 with the pendulum joint 5, with some regions only shown in part. For the sake of simplicity, the pendulum column 3 has only been shown in this drawing insofar as that the lower end thereof, referred to as the supporting leg end 13, is displayed. The seating is equipped according to the invention with a safety element 7. The safety element 7 is formed in the pendulum joint as a deflection limit 8, the structure of which is described in greater detail below.

FIG. 5*a* to *f* show the pendulum joint 5 with the safety element 7 according to the invention.

Reference is made to FIG. 5*a*. In the pendulum joint 5, the deflection limit 8 comprises a receiving unit 9 which is rotatably mounted in the central opening 102 of the foot part 2. In the receiving unit 9, a pivot cup 10 made of an elastomer is inserted, the resilient wall 11 and resilient base 12 of which are in contact with the inner wall and the base of the receiving unit 9. The supporting leg end 13 is received and held resiliently in the pivot cup 10. The elastomer material of the pivot cup 10 is designed with clearances 100 in a suitable manner relative to the outer wall of the supporting leg end 13 and has a sufficient softness to be able to allow rocking movements of the supporting leg end 13 held in the pivot cup 10. In this case, the resilient material of the pivot cup is displaced into the clearances, from which it returns to the resting position when a restoring torque is applied.

The wall 11 of the pivot cup 10 is equipped in the region 14 in the upper third of the cup with a circumferential bead 151 which extends radially inwardly. In this embodiment, in accordance with the vector diagram in FIG. 2*b*, the course of the flexibility of said bead extends symmetrically to the main axis A-A. In the preferred embodiment shown in the drawings, the plane in which the bead 151 extends forwards out of the horizontal is inclined downwards. In the embodiment shown, the angle of inclination β is 12 degrees. However, depending on the field of application, the angle of inclination β can be modified so that the restoring torque which counteracts a deflection towards the front is stronger or weaker.

The continuous change in the flexibility of the bead 151 in particular in the rear region, but also towards the side, is provided, in addition to a particular shape of the base of the pivot cup 10, which is explained in greater detail below, by a crescent-shaped insert 23, which is inserted on the outer wall of the pivot cup 10 in a crescent-shaped recess 18 formed therein in accordance with the shape of the insert 23. The crescent shape means that the resilience of the annular bead 151 continuously increases gradually from the pendulum vector $V_P$ directed precisely towards the back, in which the deflectability is substantially equal to zero, to the deflection towards the front over a range of 180° on each of the two sides of the axis A-A.

In an angular range α of 30° on each of the two sides of the axis A-A, an inwardly projecting additional protrusion in the form of a circular segment 152 is formed in the course of the bead such that it extends in a straight line in the angular range α. The angular range α can also be varied so that the region, in which the pendulum vector has only a low value, extends over a wider rear region.

In the embodiment shown in FIG. 5*a-c*, the material thickness of the bead of the pivot cup 10 in the region over which the crescent-shaped insert 23 extends, has a low wall thickness, i.e. approximately 2 mm. In this embodiment, it increases continuously over the circumference on both sides as far as the axis B-B and, in the 180° range in front of the axis line B-B from FIG. 2*b*, has such a wall thickness that the vectors $V_{Pn}$ of the pendulum profile produce the diagram in FIG. 2*b*. The wall thickness in front of the axis B-B can increase continuously, but it can also remain constant, and therefore the pendulum deflections in the lateral region are not as great as in the case of an embodiment where the wall thickness continuously increases.

The pendulum behaviour is supported by a particular design of the base of the supporting leg end in corresponding interaction with an additional design of the inner side in the lower region of the wall 11 and the base 12 of the pivot cup 10. For this purpose, the region of the wall 11 of the pivot cup 10, which is opposite the region of the crescent-shaped insert 23, is provided with a cone-shaped recess 18 inside the cup. A nose-protrusion 19 formed in the lower region of the supporting leg end 13 opposite the recess 18 fits into the recess.

The base 12 of the pivot cup 10 is formed so as to be thinner in the region 20 underneath the insert 23 than in the region 21 underneath the recess 18. The thinner base region 20 of the pivot cup 10 rests on a base region in the receiving unit 9, which region has a thickening on the underneath thereof which is used as a support.

The supporting leg end 13 is designed with an end plate 25. On said plate, a resilient tension element 26 formed in the manner of a rubber-bonded metal is arranged, wherein the tension element comprises a fastening bolt 27 which is guided through aligned openings 28 in the supporting leg end 13, the pivot cup 10 and the receiving unit 9 and is adjustably screwed together on the outside under the receiving unit by means of a fastening nut 29; cf. also FIGS. 6 and 7*a* to 7*c*. The base is formed so as to be thicker in the region 17 underneath the recess 18. In this region, the front part of the end plate is pressed in in the case of a pendulum movement towards the front, so that by means of the inclination of the material, after the displacement thereof by means of the pendulum movement towards the front in order to return to its original position, an additional restoring torque is produced (cf. FIG. 5*c*).

FIG. 5*e* shows a supporting leg end 13 with a flat portion 153 and a groove 122. Relative to the straight line 152 of the circular segment protrusion 15, the supporting leg end 13 is provided on the outer wall thereof with a flat portion 153 which is complementary to the shape of the protrusion 15.

Figure 5F:
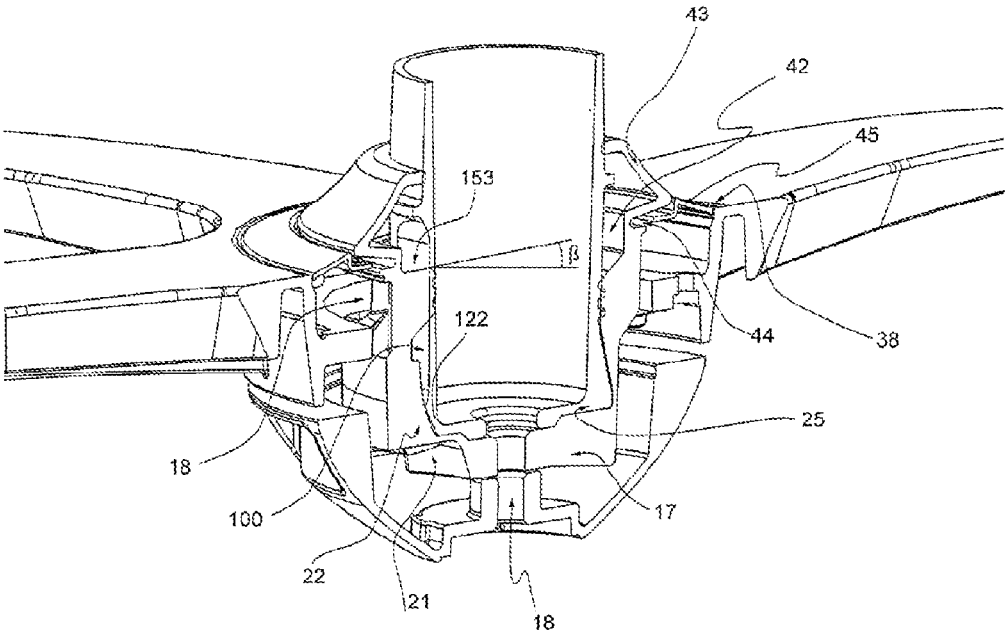

In FIG. 5*f*, a perspective view of the section from FIG. 4 is shown. For the sake of clarity, the receiving unit has not been shown. In the base region 21 of the pivot cup 10 underneath the recess 18, a handle-like rib 22 protruding upwards is formed in the pivot cup 10, which rib engages in a correspondingly shaped groove 122 in the base region of the supporting leg end 13 or of the end plate 25. By means of the flat portion 153 and the engagement of the rib 22 in the groove 122, after the insertion of the supporting leg end 13, the pendulum column is fixed relative to the pivot cup 10.

FIGS. 6 and 7*a* to 7*c* show schematic front views of a section through the foot part comprising the pendulum joint along the axis B-B, with some regions only shown in part, wherein FIGS. 7*a* to 7*c* are enlarged views of the detail B from FIG. 6, i.e. a view of the pendulum joint in differently inclined positions. The base 12 is provided along the entire width thereof view of the section along the axis B-B with the thickened region 17, so that in each case a sufficient restoring force is provided. The bead 151 arranged in the upper region 14 of the pivot cup abuts both sides of the supporting leg end with the same pressure.

The views of the supporting leg end 13 shown in FIGS. 7*a* and 7*c* show rocking positions to the left and back to the right. The restoring forces of the pivot cup act on the supporting leg end in each case in the location where, for the sake of better visibility, the covering of the wall of the supporting leg end with the ribbed edge of the bead 151 is shown, such that said leg end has the tendency to return to the vertical.

FIG. 7*b* shows a view of the pendulum joint 5 from FIG. 6 in the vertical position. The circumferential bead 151 and the protrusion 15 are in contact with the outer wall of the supporting leg end so that the same retaining forces are effectively distributed over the circumference of said leg end in the resting position.

In FIGS. 8 and 9, the arrangement of the pendulum joint 5 is shown in detail in section along the axis B-B in FIG. 3. The receiving unit 9 is provided on the upper opening 30 thereof with a circumferential edge extending radially outwards. The edge is in the form of an upper bearing ring 32 and is provided with a bearing passage 33 pointing downwards. In the central opening 102 of the foot part 2, a lower bearing ring 34 with a bearing passage 133 pointing upwards is received and interacts with the upper bearing passage 33 via rolling means 24 (balls, rollers). In this case, the lower bearing ring 34 rests on a circumferential shoulder 202 formed in the central opening 102 and pointing radially inwards, on which shoulder a receiving surface 35 is formed.

The bearing ring 34 has an L-shaped cross section, wherein the upwardly projecting free arm is provided with an internal thread on the wall thereof which points radially inwards. The thread is in the form of a fine thread. The horizontal arm of the L-shaped cross section comprises the bearing passage 133 which points upwards.

The receiving unit 9 rests with the radially outwardly pointing bearing ring edge thereof on the horizontal shoulder of the lower bearing ring 34, with the rolling means 24 interposed therebetween. The adjusting ring 37 which is screwed into the thread of the bearing ring 34 impinges with the lower side thereof on the upper surface 31 of the circumferential bearing ring 32 of the receiving unit 9 from above and rests on said ring in sliding contact. By means of the adjusting ring 37, bias is produced between the two bearing rings 32 and 34. The bearing ring 34 is preferably screwed to the shoulder 202 of the central opening 102 from below by means of screw connections (not shown).

Reference is now made to FIGS. 10 to 12. The adjusting ring 37 is part of a measuring device 35, which is designed according to the principle of a micrometer. For this purpose, the adjusting ring 37 comprises eight threaded holes ($G_1$-$G_8$) for fastening a cover ring 38. The cover ring 38 comprises four through-holes 39 and three pins 40 pointing downwards which can interact with nine measuring holes ($m_1$-$m_9$) in the lower bearing ring 34. All of the holes and the pins are concentric and are symmetrical to one another with respect to the angular distance thereof, with the condition that one pin 40 and one through-hole 39 in the cover ring are located on a common radius. The cover ring 38 is screwed onto the adjusting ring 37 by means of screws 139 which are guided through the through-holes. Thus the adjusting ring 37 can be screwed into the lower bearing ring by rotating the cover ring 38.

One of the measuring holes ($m_1$) is arranged precisely symmetrically between two threaded holes ($G_1$, $G_2$). This design allows precise bias on the rolling means 24 which allow rotation of the pendulum joint in the foot part 2 between the bearing rings. In a variant which is not shown, instead of the ball bearing shown, a plain bearing can also be used, without the tensioning means having to be changed.

The pivot cup 10 is equipped around the upper opening 42 thereof with a sealing sleeve 43 and underneath said sleeve with a circumferential groove 44 on the outer circumference thereof, into which groove a retaining rib 45 which is formed on the inner circumferential edge of the cover ring 38 and points inwards is inserted.

In the embodiment described, the means for defining the backward direction is a backrest 46.

However, the means for defining the backward direction can also consist in the fact that the seat is in the shape of a saddle.

The invention claimed is:

1. Actively dynamic seating (1) comprising a foot part (2), a seat (3) and a deflectable pendulum column (4) in the form of a supporting leg, which column is connected to the foot part (2) by means of a pendulum joint (5) which counteracts a deflection with a restoring torque and at/on which column the seat (3) is spring-mounted, and comprising a device (6) which is arranged on the seat for defining a backward direction, wherein the foot part (2) of the seating is equipped with a safety element (7) which counteracts a rocking movement of the pendulum column (4) towards the backward direction with a resistance which is higher than a resistance of the restoring torque in other directions than the backward direction, the pendulum joint (5) comprises a pivot cup (10) which is made of an elastomer, has a resilient wall (11) and a resilient base (12), and is arranged in the foot part (2) in a rotatably mounted receiving unit (9), the pendulum column (4) being provided with a supporting leg end (13) on the lower end thereof, which end is resiliently received in the pivot cup (10), for the deflection limit, the wall of the pivot cup (10) comprises a radially inwardly projecting protrusion (15) in the region of an upper edge (14) in a rear region, which protrusion has a lower flexibility than a bead (151) which is formed in the remaining region on an inner circumference of the pivot cup (10), an outer wall (16) of a supporting leg end (13) being in contact with the protrusion (15) and the bead, and the protrusion (15) projects in the form of a circular segment into the pivot cup (10) and a detachable crescent-shaped insert (23) is arranged at the location of the circular segment outside of the pivot cup, which insert stiffens the protrusion (15).

2. Seating according to claim 1, wherein the safety element (7) has a deflection limit (8) formed in the pendulum joint (5).

3. Seating according to claim 1, wherein the wall (11) of the pivot cup (10) comprises a recess (18) in the base region (17) relative to the region comprising the protrusion (15), in which widening a nose-protrusion (19) formed in a base region of the supporting leg end (13) engages.

4. Seating according to claim 3, wherein the base (12) of the pivot cup (10) is formed so as to be thinner in the region (20) underneath the protrusion (15) than in the region (21) underneath the recess (18), and the thinner base region (20) is supported on a thicker base region, in the form of a support, of the receiving unit (9).

5. Seating according to claim 1, wherein the insert (23) is inserted into a correspondingly shaped insert recess (18).

6. Seating according to claim 1, wherein the supporting leg end (13) is designed with an end plate (25), and a resilient tension element (26) which is formed in the manner of a rubber-bonded metal is arranged on the end plate (25), the tension element comprising a fastening bolt (27) which is guided through aligned openings (28) in the supporting leg end (13), the pivot cup (10) and the receiving unit (9) and is adjustably screwed together outside and under the receiving unit by means of a fastening nut (29).

7. Seating according to claim 6, wherein the receiving unit (9) is provided on the upper opening (30) thereof with a circumferential edge (32) extending radially outwards in the form of an upper bearing ring having a bearing passage (33) pointing downwards, which edge interacts directly or indirectly with a lower bearing ring (34) provided in the foot part (2) and having a bearing passage (133) pointing upwards, the receiving unit (9) being held on a receiving surface (35) in the foot part (2) by means of a threaded ring in the form of an adjusting ring (37) such that the receiving unit (9) can rotate.

8. Seating according to claim 7, wherein on the adjusting ring (37), which has a fine thread and which impinges on the circumferential edge of the receiving unit (9) from above and rests thereon in sliding contact, and on the lower bearing ring (34) a measuring device (36) is formed according to the principle of a micrometer.

9. Seating according to claim 7, wherein in the adjusting ring (37), eight threaded holes ($G_1$-$G_8$) for a cover ring (38) with four through-holes (39) for a screw fastening are formed, the cover ring (38) comprising three measuring pins (40) pointing downwards which can interact with nine measuring holes ($m_1$-$m_9$) in the lower bearing ring, all of the holes being concentric with one another and each being at the same angular distance from one another, with the condition that a measuring pin (40) of the cover ring (38) and a through-hole in the cover ring (38) are located on a common radius.

10. Seating according to claim 1, wherein the seat (3), the pendulum column (4), and the pendulum joint (5) are interconnected for conjoint rotation to form a unit that is mounted so as to be able to rotate about a column axis "S" relative to the foot part (2).

11. Seating according to claim 1, wherein the protrusion (15) has a straight path over a circumferential angle "α" of approximately 45°, a corresponding straight surface (153) being formed on the supporting leg end (13), the circumferential bead (151) being in contact with the wall of the supporting leg end (13) in a remaining circumferential region and holding said leg end in the vertical position in a deflectable manner.

12. Seating according to claim 1, wherein, in the end plate (25) of the supporting leg end (13), a recess (122) is made, into which a rib (22) enters, the rib being formed opposite and inside the pivot cup.

13. Seating according to claim 1, wherein the pivot cup (10) comprises a sealing sleeve (43) around the upper opening (42) thereof and, underneath said sleeve, a circumferential groove (44) on the outer circumference, into which groove a retaining rib (45) formed on an inner circumferential edge of a cover ring (38) is inserted.

14. Seating according to claim 1, wherein the device for defining the backward direction is a backrest (46).

15. Seating according to claim 1, wherein the device for defining the backward direction is a seat in the shape of a saddle.

16. Actively dynamic seating (1) comprising a foot part (2), a seat (3) and a deflectable pendulum column (4) in the form of a supporting leg, which column is connected to the foot part (2) by means of a pendulum joint (5) which counteracts a deflection with a restoring torque and at/on which column the seat (3) is spring-mounted, and comprising a device (6) which is arranged on the seat for defining a backward direction, wherein the foot part (2) of the seating is equipped with a safety element (7) which counteracts a rocking movement of the pendulum column (4) towards the backward direction with a resistance which is higher than a resistance of the restoring torque in other directions than the backward direction, the pendulum joint (5) comprises a pivot cup (10) which is made of an elastomer, has a resilient wall (11) and a resilient base (12), and is arranged in the foot part (2) in a rotatably mounted receiving unit (9), the pendulum column (4) being provided with a supporting leg end (13) on the lower end thereof, which end is resiliently received in the pivot cup (10), and the supporting leg end (13) is designed with an end plate (25), and a resilient tension element (26) which is formed in the manner of a rubber-bonded metal is arranged on the end plate (25), the tension element comprising a fastening bolt (27) which is guided through aligned openings (28) in the supporting leg end (13), the pivot cup (10) and the receiving unit (9) and is adjustably screwed together outside and under the receiving unit by means of a fastening nut (29).

17. Actively dynamic seating (1) comprising a foot part (2), a seat (3) and a deflectable pendulum column (4) in the form of a supporting leg, which column is connected to the foot part (2) by means of a pendulum joint (5) which counteracts a deflection with a restoring torque and at/on which column the seat (3) is spring-mounted, and comprising a device (6) which is arranged on the seat for defining a backward direction, wherein the foot part (2) of the seating is equipped with a safety element (7) which counteracts a rocking movement of the pendulum column (4) towards the backward direction with a resistance which is higher than a resistance of the restoring torque in other directions than the backward direction, the pendulum joint (5) comprises a pivot cup (10) which is made of an elastomer, has a resilient wall (11) and a resilient base (12), and is arranged in the foot part (2) in a rotatably mounted receiving unit (9), the pendulum column (4) being provided with a supporting leg end (13) on the lower end thereof, which end is resiliently received in the pivot cup (10), and in the end plate (25) of the supporting leg end (13), a recess (122) is made, into which a rib (22) enters, the rib being formed opposite and inside the pivot cup.

* * * * *